US008628219B2

(12) United States Patent
Peck et al.

(10) Patent No.: US 8,628,219 B2
(45) Date of Patent: Jan. 14, 2014

(54) COMPACT OMNIDIRECTIONAL LED LIGHT

(75) Inventors: John Patrick Peck, Manasquan, NJ (US); Anthony Verdes, Brick, NJ (US); Kevin A. Hebborn, Toms River, NJ (US)

(73) Assignee: Dialight Corporation, Farmingdale, NJ (US)

( * ) Notice: Subject to any disclaimer, the term of this patent is extended or adjusted under 35 U.S.C. 154(b) by 424 days.

(21) Appl. No.: 12/208,941

(22) Filed: Sep. 11, 2008

(65) Prior Publication Data

US 2009/0073697 A1 Mar. 19, 2009

Related U.S. Application Data

(60) Provisional application No. 60/971,793, filed on Sep. 12, 2007.

(51) Int. Cl.
*F21V 7/09* (2006.01)

(52) U.S. Cl.
USPC . 362/296.05; 362/241; 362/245; 362/249.11; 362/249.02; 362/373

(58) Field of Classification Search
USPC ..... 362/296.05, 241, 243, 245, 249.02, 362/249.11, 311.02, 328, 345, 373
See application file for complete search history.

(56) References Cited

U.S. PATENT DOCUMENTS

| | | | | |
|---|---|---|---|---|
| 6,183,100 | B1 | 2/2001 | Suckow | |
| 2002/0093820 | A1 | 7/2002 | Pederson | |
| 2005/0110649 | A1 | 5/2005 | Fredericks | |
| 2005/0128744 | A1 * | 6/2005 | You et al. | 362/241 |
| 2006/0119250 | A1 | 6/2006 | Suehiro et al. | |

FOREIGN PATENT DOCUMENTS

EP 1 113 215 A2 7/2001

OTHER PUBLICATIONS

PCT International Search Report and Written Opinion for PCT/US08/76054, Mar. 13, 2009, consists of 8 unnumbered pages.
Office Action from MX/a/2010/002830, Dec. 12, 2011, consists of 4 pages. (submitted with Agent's translation dated Jan. 25, 2011).
Office Action from CA 2,699,294, dated Oct. 18, 2011, pp. 1-3.
EP Search Report for EP Patent Application Serial No. 08830100.7-1755/2191195, search completed Aug. 16, 2013, consists of 6 unnumbered pages.

* cited by examiner

*Primary Examiner* — Sharon Payne

(57) ABSTRACT

The present invention is directed to a compact omnidirectional light emitting diode (LED) light. In one embodiment, the compact omnidirectional light includes a metal base including a stalk, a power supply coupled to the metal base, a reflector including one or more reflector cups coupled to the metal base and enclosing the power supply, an LED circuit board including one or more LEDs coupled to the reflector and a lens coupled to the metal base and enclosing the LED circuit board and the reflector, wherein the lens surface is smooth.

18 Claims, 11 Drawing Sheets

COMPACT OMNIDIRECTIONAL LED LIGHT

RELATED APPLICATIONS

This application claims priority under 35 U.S.C. §119(e) to U.S. provisional patent application Ser. No. 60/971,793, filed on Sep. 12, 2007, which is hereby incorporated by reference in its entirety.

FIELD OF THE INVENTION

The present invention is directed to an LED (light emitting diode) light used as an omnidirectional visual indicator light such as an airfield light, aircraft obstruction light, or other beacon style light.

BACKGROUND OF THE INVENTION

Commonly, beacon lights are made using a Fresnel lens revolved around a central light source. In the past, incandescent bulbs or other traditional light sources were used. More recently LEDs have been used as the light source.

This approach using a Fresnel lens suffers from several deficiencies. One deficiency arises because the outer surface of the Fresnel lens has optical features and is not smooth. Dirt and ice may accumulate and obstruct the light output. A second deficiency is the poor optical efficiency of the Fresnel lens when used with common high-power LEDs.

In addition, the high power LEDs are being used in more applications. However, high power LEDs generally emit light in a very wide angular pattern. This wide pattern does not work well with the revolved Fresnel lens because most of the high-angle light is not collected by the Fresnel lens.

SUMMARY OF THE INVENTION

The present invention relates generally to a compact omnidirectional light emitting diode (LED) light. In one embodiment, the compact omnidirectional LED light comprises a metal base including a stalk, a power supply coupled to the metal base, a reflector including one or more reflector cups coupled to the metal base and enclosing the power supply, an LED circuit board including one or more LEDs coupled to the reflector and a lens coupled to the metal base and enclosing the LED circuit board and the reflector, wherein the lens surface is smooth.

In one embodiment, the present invention provides a compact omnidirectional LED light comprising a reflector comprising one or more reflector cups, an LED circuit board comprising one or more LEDs coupled to said reflector, a heat sink coupled to said LED circuit board, at least one LED coupled to said heat sink, a metal base comprising a stalk coupled to said reflector and a lens coupled to said metal base and enclosing said LED circuit board, said reflector, said heat sink and said at least one LED coupled to said heat sink, wherein said lens surface is smooth.

In one embodiment, the present invention provides a reflector for use in a compact omnidirectional light emitting diode (LED) light comprising. The reflector comprises a cavity for enclosing a power supply, a means for coupling one or more LEDs to an opposite side of said cavity and one or more reflector cups made of metalized plastic opposite said cavity for receiving a respective one of said one or more LEDs. The one or more reflector cups comprise a conic shape and two different axes of curvature.

BRIEF DESCRIPTION OF THE DRAWINGS

So that the manner in which the above recited features of the present invention can be understood in detail, a more particular description of the invention, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention resolve the above noted problems associated with using a combination of a high power LED and a Fresnel lens. For example, the present invention utilizes optical designs such metalized plastic reflectors or internal lenses to create a more efficient optical system. This allows the outer lens to be a simple smooth dome. The dome can be thin walled and have minimum features. This results in a lighter weight and lower cost product.

Figure 1:
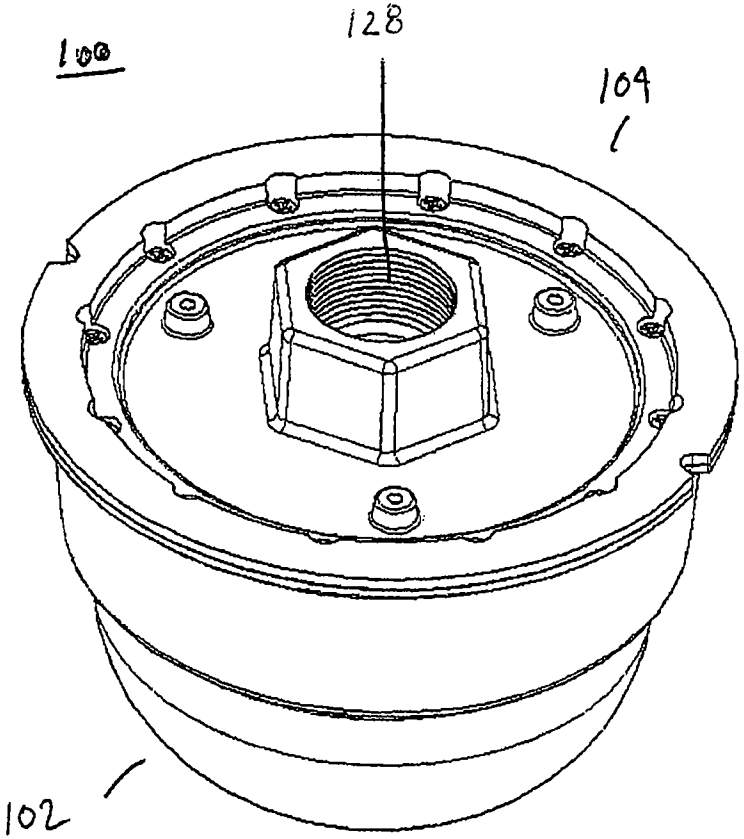
FIG. 1 depicts a bottom isometric view of one embodiment of a compact omnidirectional LED light.

FIG. 1 illustrates a bottom isometric view of one embodiment of a compact omnidirectional LED light 100. The compact omnidirectional LED light 100 comprises a lens 102 and a metal base 104. The lens 102 may be a plastic lens in a dome shape with a smooth outer surface and no optical features to enclose a light fixture within the compact omnidirectional LED light 100. In other words, the lens 102 may be free of optical features. The diameter of the lens 102 may be chosen to fit a base of the most common incandescent fixture. A small lens diameter results in a challenging optical design and power supply design. For example, many narrow beam optical systems are etandue limited and require large optics. In one embodiment, the diameter of the lens 102 may be between 3.5 and 5.5 inches. This allows the unit to be retrofitted onto the base of an incandescent light fixture. As a result, a glass dome of the incandescent light, light bulb and light bulb socket may be removed and the compact omnidirectional LED light 100 may be mounted onto the existing base using the existing clamp from the incandescent light.

Figure 11:
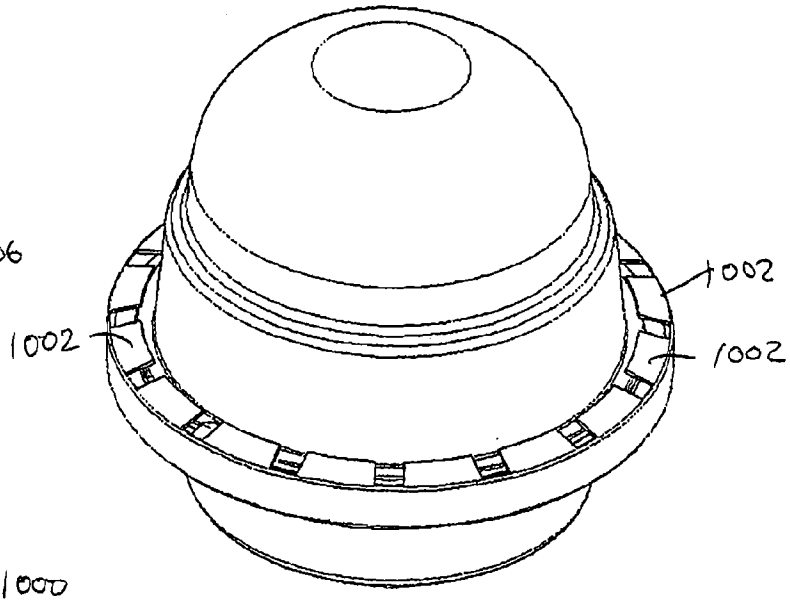
FIG. 11 depicts one embodiment of the collar coupled compact omnidirectional LED light.
Figure 10:
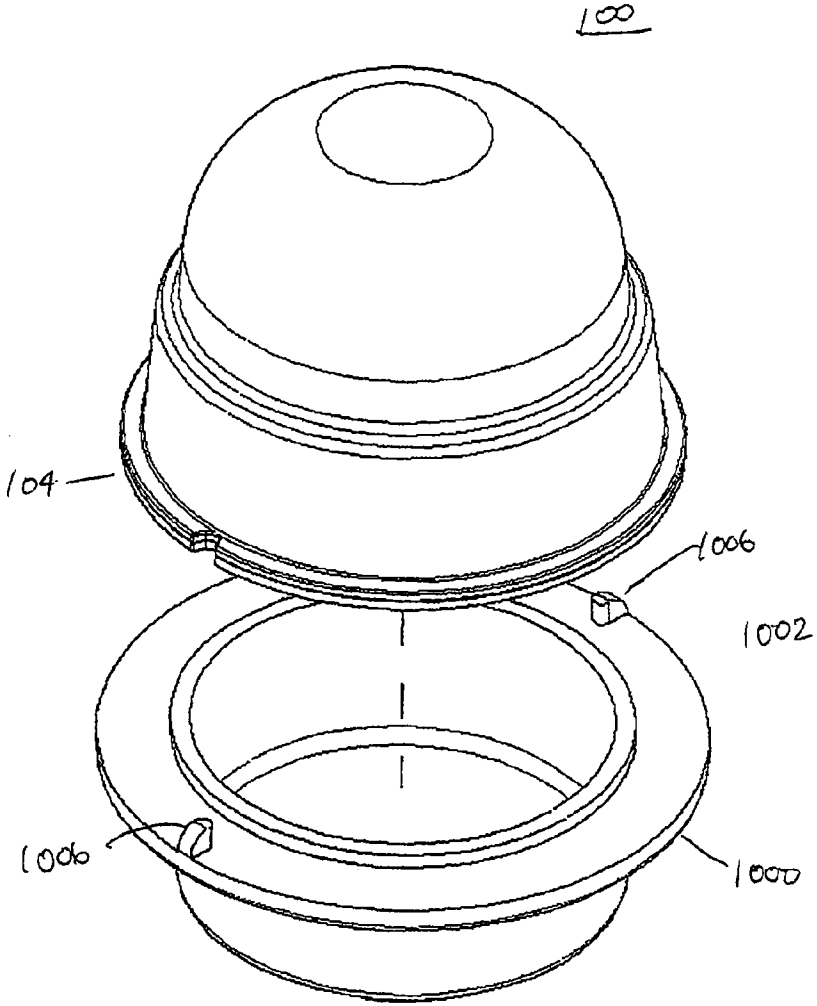
FIG. 10 depicts one embodiment of a collar coupled to the compact omnidirectional LED light.

The metal base 104 may be designed to be fitted with various collars for various mounting configurations of the compact omnidirectional LED light 100 as illustrated in FIGS. 10-17. In one embodiment, as illustrated in FIG. 10, the compact omnidirectional LED light 100 may be mounted on a collar 1000. One or more tabs 1006 on the collar 1000 may be used to guide and align the metal base 104 onto the collar 1000. As illustrated by FIG. 11, the compact omnidirectional LED light 100 may then be secured via tabs 1002.

Figure 12:
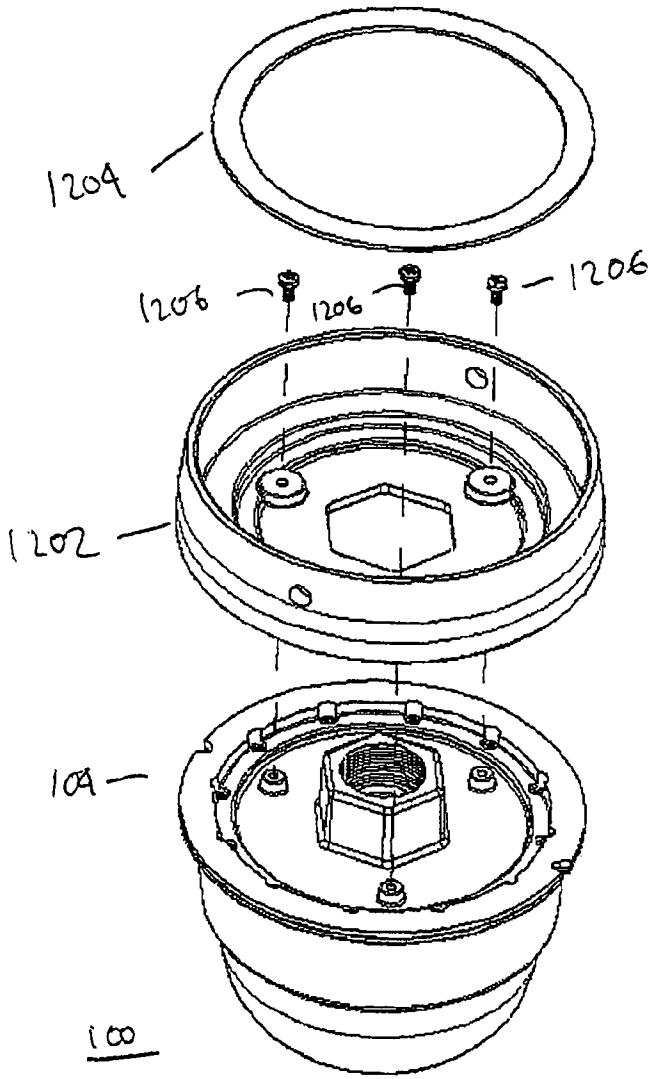
FIG. 12 depicts an exploded view of one alternate embodiment of a collar coupled to the compact omnidirectional LED light.

In another embodiment illustrated in FIG. 12, a collar 1202 may be coupled to the metal base 104 of the compact omnidirectional LED light 100. The collar 1202 may be coupled to the compact omnidirectional LED light 100 via one or more screws 1206. A gasket 1204 may be used to create a proper seal to whatever mounting member (not shown) is used to mount the compact omnidirectional LED light 100 fitted with the collar 1202. In one embodiment, a second gasket (not shown) may be used between the metal base 104 and the collar 1202 to provide an additional seal.

Figure 13:
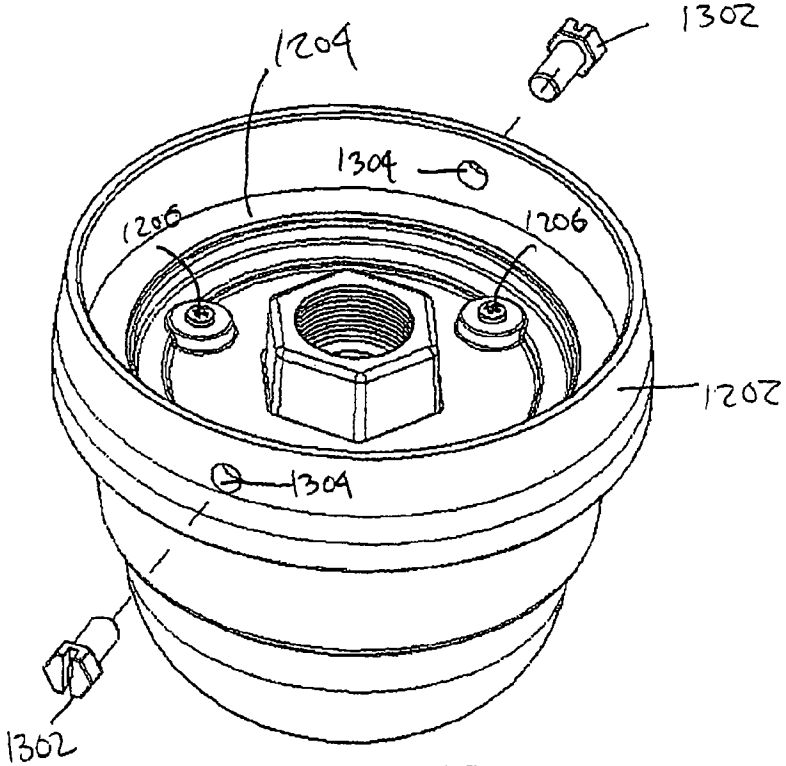
FIG. 13 depicts one embodiment of the compact omnidirectional LED light assembled with the collar.

The fully assembled compact omnidirectional LED light 100 with the collar 1202 is illustrated in FIG. 13. The collar 1202 may also include one or more holes 1304, such that one or more screws 1302 may be used to further couple or secure the compact omnidirectional LED light 100 to whatever mounting member is used.

For example, using the collar 1202 illustrated in FIGS. 12 and 13, two of the compact omnidirectional LED lights 100 may be mounted together on a dual metal housing 1400 for simultaneous use or single use with the second compact omnidirectional LED light 100 being used as a backup in case of failure.

Figure 15:
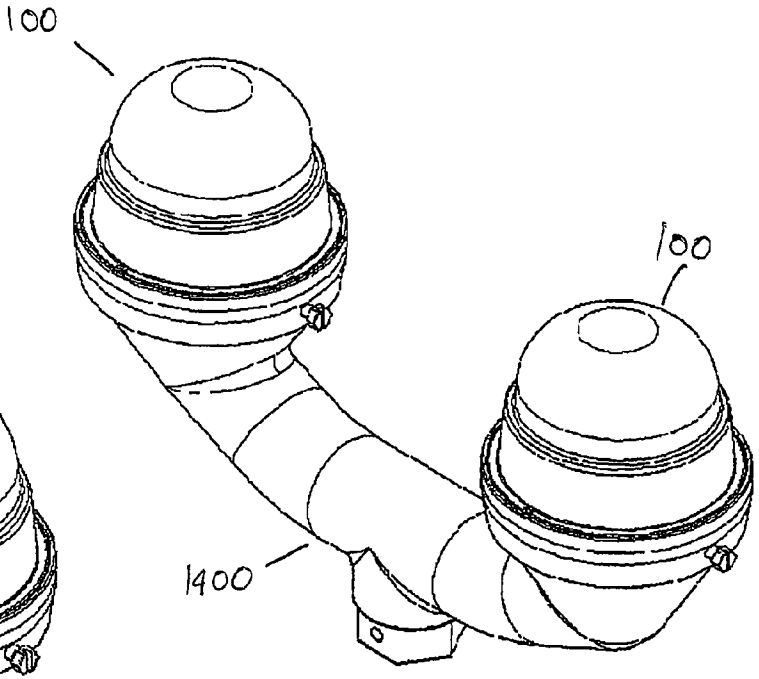
FIG. 15 depicts another view of one embodiment of the two compact omnidirectional LED lights mounted on the dual housing.
Figure 14:
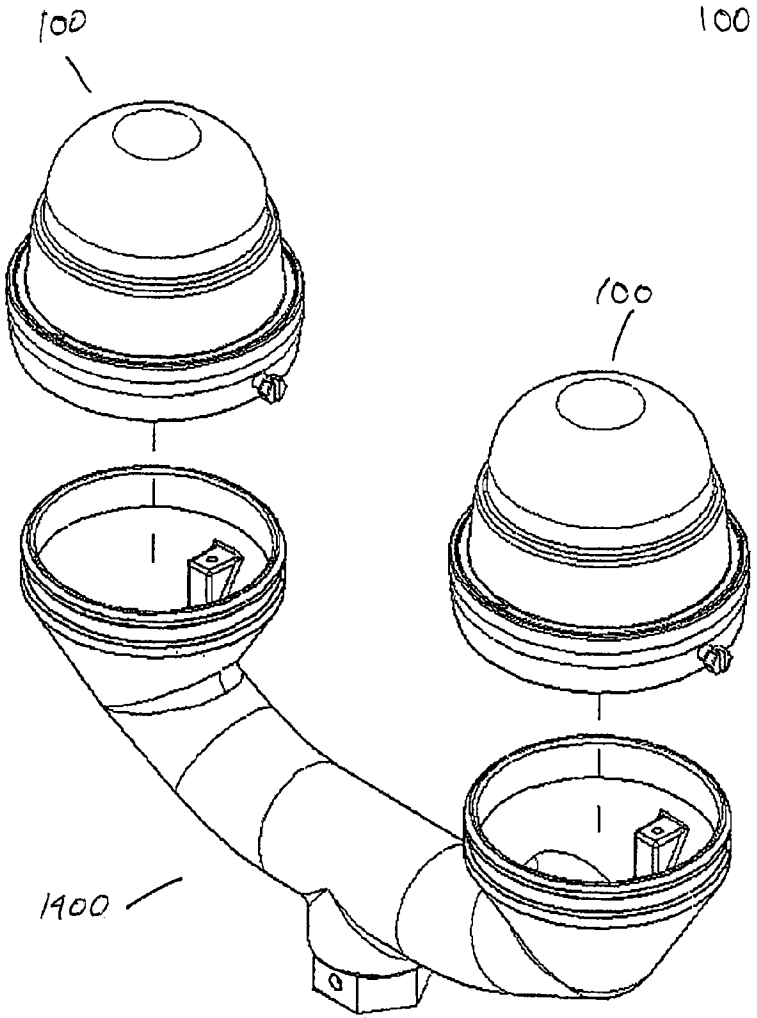
FIG. 14 depicts one embodiment of two compact omnidirectional LED lights mounted on a dual housing.
Figure 17:
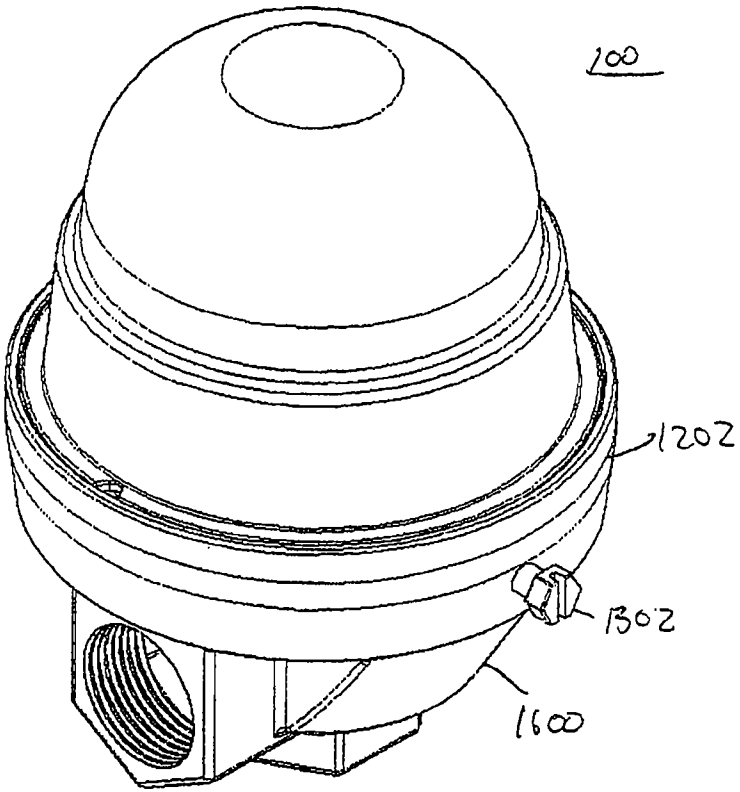
FIG. 17 depicts another view of one embodiment of compact omnidirectional LED light mounted on the metal housing.
Figure 16:
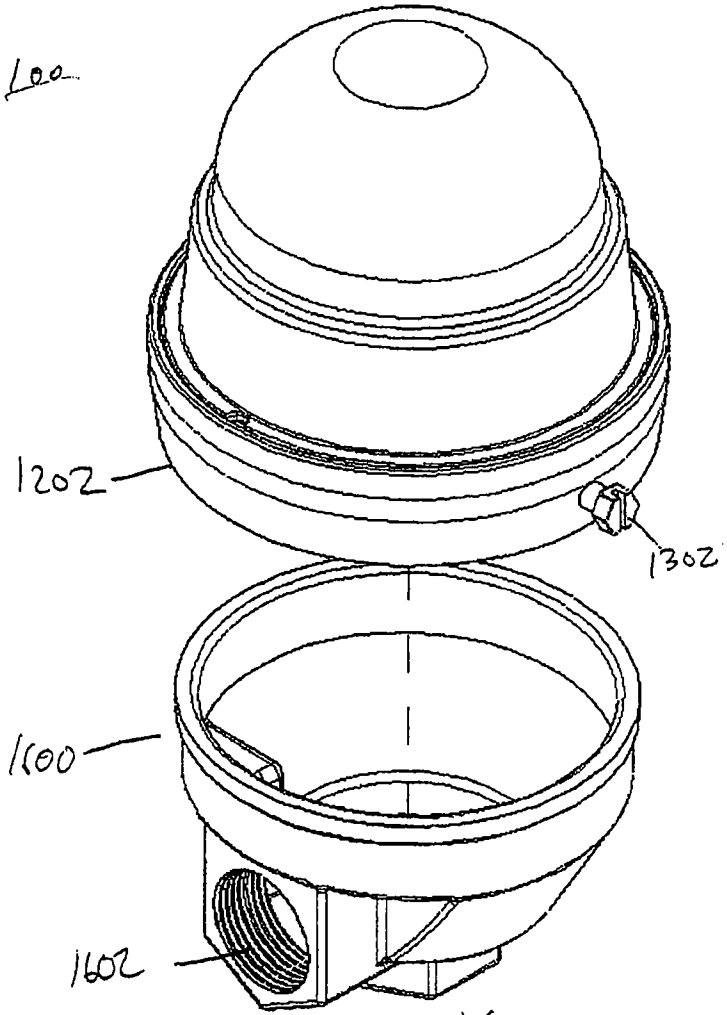
FIG. 16 depicts one embodiment of the compact omnidirectional LED light mounted on a metal housing.

An example of this configuration is illustrated in FIGS. 14 and 15. In FIG. 14, an exploded view is provided illustrating how the two compact omnidirectional LED lights 100 may be coupled to the dual metal housing 1400. FIG. 15 illustrates one example of two compact omnidirectional LED lights 100 fully assembled with the dual metal housing 1400.

In yet another embodiment, the compact omnidirectional LED light 100 fitted with the collar 1202 may be coupled to a housing 1600 for coupling to a conduit sideways. For example, the housing 1600 may include a threaded hole 1602 for coupling to a conduit or pipe. Those skilled in the art will recognize that a diameter of the threaded hole 1602 may be any diameter to match a diameter of the conduit or pipe that the housing 1600 will be coupled to.

Referring back to FIG. 1, the metal base 104 may be constructed from aluminum, or any other thermally conductive material, to help conduct heat out of the inside of compact omnidirectional LED light 100. High temperatures cause light degradation and shorten LED life. Therefore, it is very important to have a highly efficiency optical design that uses the minimum number of LEDs. In one embodiment, between 2 and 5 watts of LEDs are used. Also, a proper base design will result in a low thermal resistance between the LEDs and the outside air. In one embodiment, the metal base consists of between 0.2 and 1.0 pound of metal.

The metal base 104 may also serve as a mounting means when the compact omnidirectional LED light 100 is required to be mounted onto the end of a conduit. In one embodiment, the metal base 104 comprises a threaded hole 128 for a pipe fitting. The threading diameter may be between 0.45 and 2.05 inches, for example, in order to provide appropriate support for the compact omnidirectional LED light 100.

Figure 9:
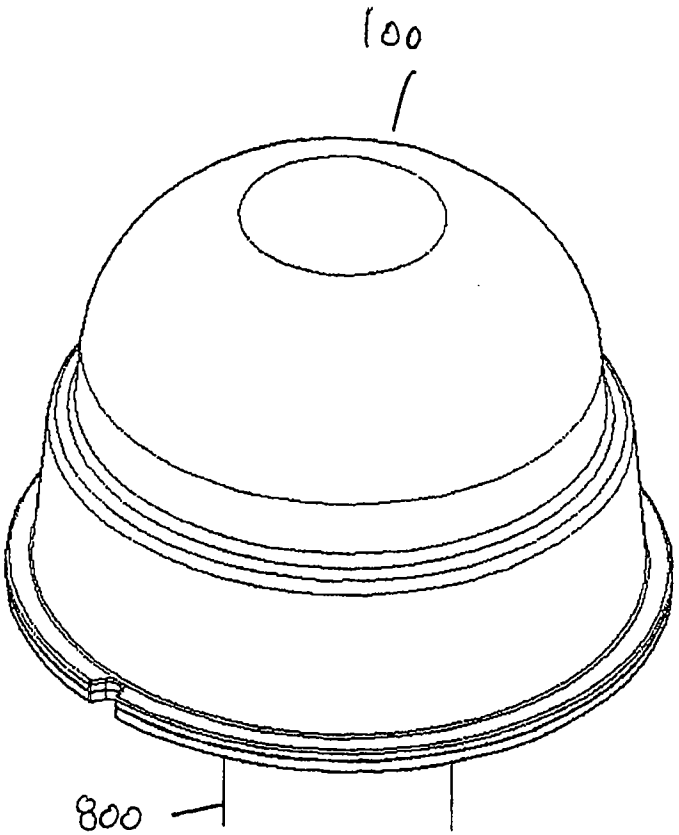
FIG. 9 depicts one embodiment of the compact omnidirectional LED light mounted on the conduit.
Figure 8:
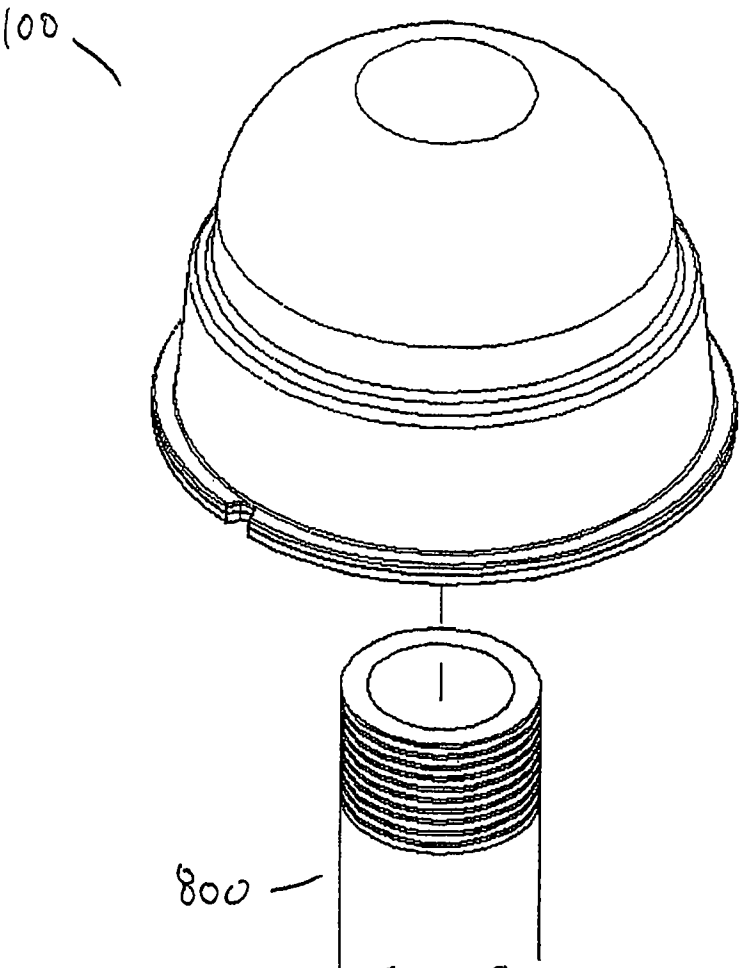
FIG. 8 depicts one embodiment of the compact omnidirectional LED light mounted on a conduit.

FIG. 8 illustrates how the compact omnidirectional LED light 100 may be mounted onto the end of a conduit 800, as described above. FIG. 9 illustrates the compact omnidirectional LED light 100 fully assembled on the conduit 800.

Figure 2:
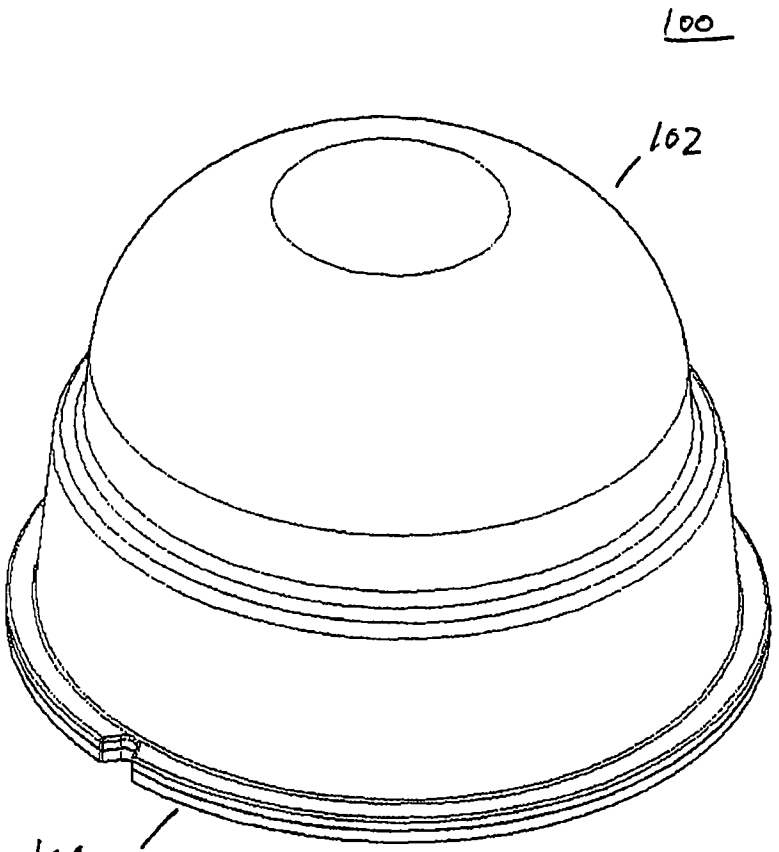
FIG. 2 depicts a top isometric view of one embodiment of the compact omnidirectional LED light.

Referring back to FIG. 1, the design of the metal base 104 also allows source wires (not shown) to travel through the center via the threaded hole 128. This is a sealed cavity eliminating the possibility of "pinching" any wires during assembly. FIG. 2 illustrates a top isometric view of the compact omnidirectional LED light 100.

Figure 3:
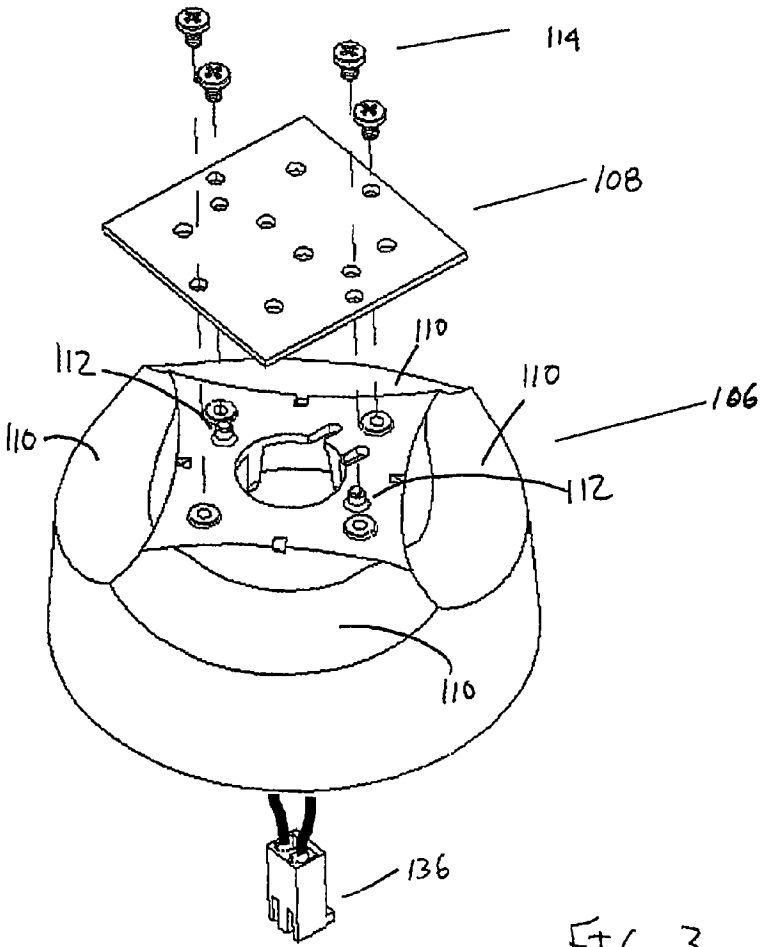
FIG. 3 depicts an exploded view of one embodiment of a metalized plastic reflector used in the compact omnidirectional LED light.

FIG. 3 illustrates an exploded view of one embodiment of a metalized plastic reflector 106 used in the compact omnidirectional LED light 100. The metalized plastic reflector 106 may also be referred to as a light engine 106 and the terms may be used herein interchangeably. The metalized plastic reflector 106 may comprise one or more reflector cups 110. The one or more reflector cups 110 may also be metalized plastic. Those skilled in the art will recognize that although FIG. 3 illustrates the metalized plastic reflector 106 and the one or more reflector cups 110 being a single piece, that the reflector cups 110 may be one or more separately fabricated pieces coupled to the metalized plastic reflector 106.

FIG. 3 illustrates one embodiment of how a LED circuit board 108 is mounted to the metalized plastic reflector 106 having four reflector cups 110. However those skilled in the art will recognize that any number of reflector cups 110 may be used and that the present invention should not be limited to any particular number of reflector cups 110 used as an example.

The LED circuit board 108 may be, for example, a metal core circuit board. In another embodiment, the metal core board is a standard circuit board that is mounted to a metal plate. The metal core board is mounted to a metal stalk, described below, and, therefore, transfers heat to the metal stalk and out of the compact omnidirectional LED light 100.

In one embodiment, LEDs (not shown) are mounted on the LED circuit board 108. Thus, the LEDs are directed along an axis of the stalk and toward the metal base 104. The LEDs point downward into one of the four metalized plastic reflector cups 110. A shape of the metalized plastic reflector cups 110 may be designed so the light from the LEDs is distributed in a full 360° radial coverage. In one embodiment, there may be two posts 112 protruding upward to accurately position the LED circuit board 108 to the metalized plastic reflector 106.

In one embodiment, the one or more reflector cups 110 are conic or conic like with two axes of curvature. The curvatures along the two axes of curvature are not the same. In one embodiment, the two axes of curvature are angled relative to each other.

The curved cross sections are formed by projecting the reflector cross section along a curved trajectory. The curved trajectory is also known as a swept curvature. In one embodiment, the one or more reflector cups 110 can be continuous and form a circle or can be segmented depending on the radius of the curved trajectory and the number of reflector segments that are used. The reflector cups 110 can be concave or convex. The reflector cups 110 shown as an example in FIG. 3 have a concave curved trajectory.

The LEDs are at about 90 degrees with respect to reflector axes. Although the present illustration depicts a configuration for four LEDs, one skilled in the art will recognize that the present invention may be configured for any number of LEDs. The LED circuit board 108 may be secured to the metalized plastic reflector 106 via screws 114.

A wire harness 136 is illustrated at the bottom of the metalized plastic reflector 106. The wire harness 136 may be attached to the LED circuit board 108 and a power supply assembly (shown in FIG. 4) to provide electrical power to the LEDs.

Figure 4:
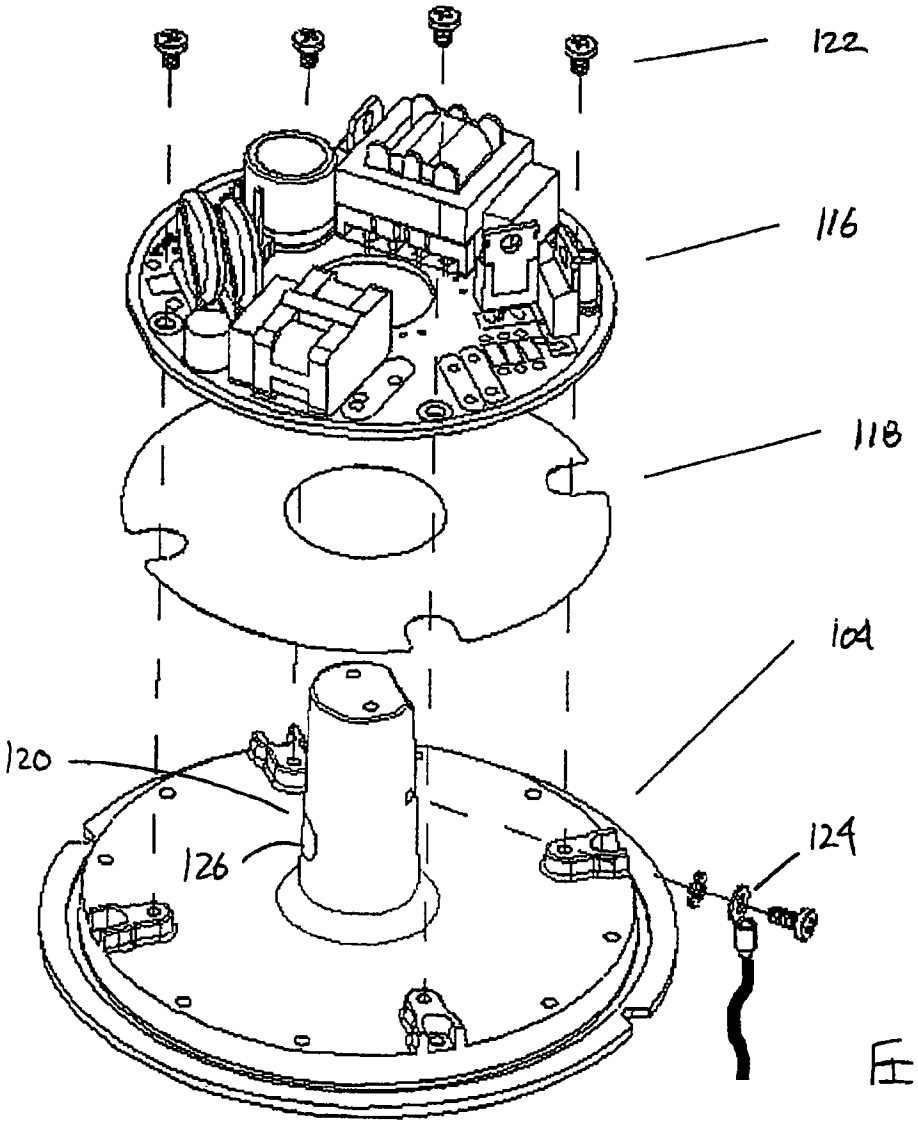
FIG. 4 depicts an exploded view of one embodiment of a power supply assembly used in the compact omnidirectional LED light.

FIG. 4 illustrates an exploded view of one embodiment of a power supply assembly 116 used in the compact omnidirectional LED light 100. The metal base 104 comprises a stalk 120. The stalk 120 provides a path for heat to travel down to the metal base 104. The stalk 120 may pass through a center of an insulator 118 and the power supply assembly 116.

Figure 5:
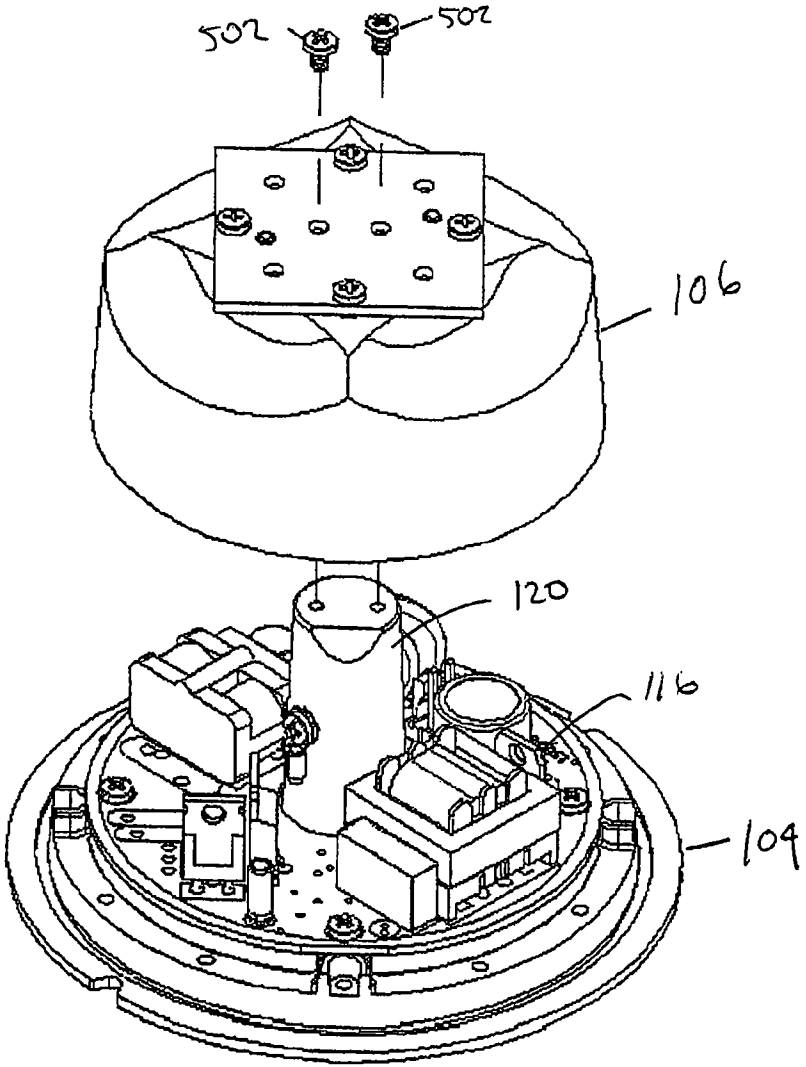
FIG. 5 depicts an exploded view of one embodiment of the power supply assembly and the metalized plastic reflector.

As illustrated in FIG. 5, the metalized plastic reflector 106 may then be placed over the power supply assembly 116 and insulator 118 and the LED circuit board 108 may be coupled to or mounted on top of the stalk 120. The plastic reflector 106 may be coupled to the stalk 120 via two screws 502.

Referring back to FIG. 4, the power supply assembly 116 may be mounted to the metal base 104 with screws 122. Placing the power supply assembly 116 adjacent to the metal base 104 provides some heat transfer from the power supply assembly 116 to the metal base 104. The metal base 104 may be grounded via ground wire 124 running through a center of the stalk 120 and out of a hole 126 in the stalk 120.

Figure 6:
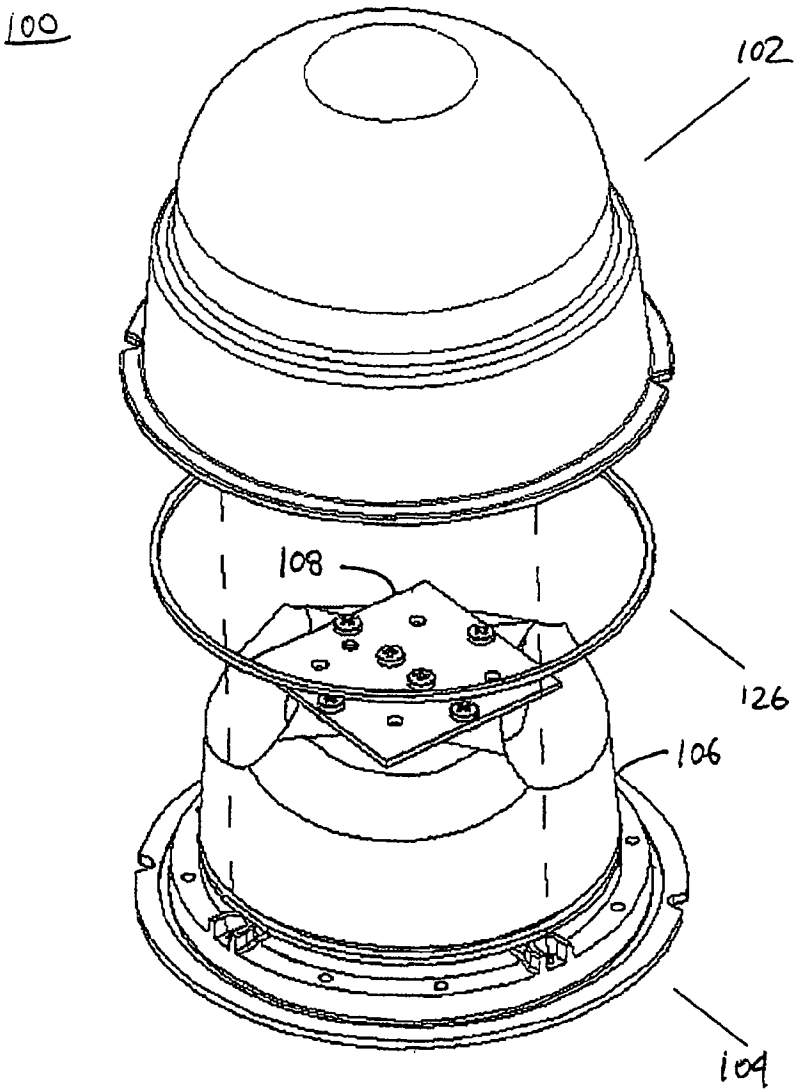
FIG. 6 depicts an exploded view of one embodiment of the compact omnidirectional LED light.

FIG. 6 illustrates an exploded view of one embodiment of the compact omnidirectional LED light 100 having the metalized plastic reflector 106 and LED circuit board 108 mounted to the metal base 104. As illustrated in FIG. 6, a gasket 126 may be used to seal the lens 102 to the metal base 104. As a result, the lens 102 may enclose the metalized plastic reflector 106 and the LED circuit board 108 when coupled to the metal base 104. Alternatively, the lens 102 may be sealed to the metal base 104 using glue or other appropriate sealing methods known to those skilled in the art. Sealing the lens 102 to the metal base 104 protects the compact omnidirectional LED light 100 from air, water and/or any other types of moisture.

As discussed above, the lens 102 may be smooth and free of optical features because of the unique design of the metalized plastic reflector 106 and the one or more reflector cups 110. The proper optical features to re-direct light emitted from the one or more LEDs is provided mostly by the metalized plastic reflector 106 and the one or more reflector cups. This reduces the cost and weight of the lens 102, thus providing a cheaper and more efficient compact omnidirectional LED light 100.

In addition, as illustrated by FIG. 6, the LEDs are mounted in an upper portion of the compact omnidirectional LED light 100 in order to allow the power supply assembly 116 to be assembled in a lower portion of the compact omnidirectional LED light 100. Having the LEDs in the upper portion allows the metalized plastic reflector 106 to create a cavity that will enclose the power supply assembly 116. That is, the metalized plastic reflector 106 may have a means for coupling the one or more LEDs of the LED circuit board 108 opposite the cavity that encloses the power supply assembly 116. Thus, the power supply assembly 116 may now have a metalized surrounding to provide electromagnetic interference (EMI) shielding. In one embodiment, the one or more reflector cups 110 described above may be opposite the cavity that encloses the power assembly 116.

Figure 7:
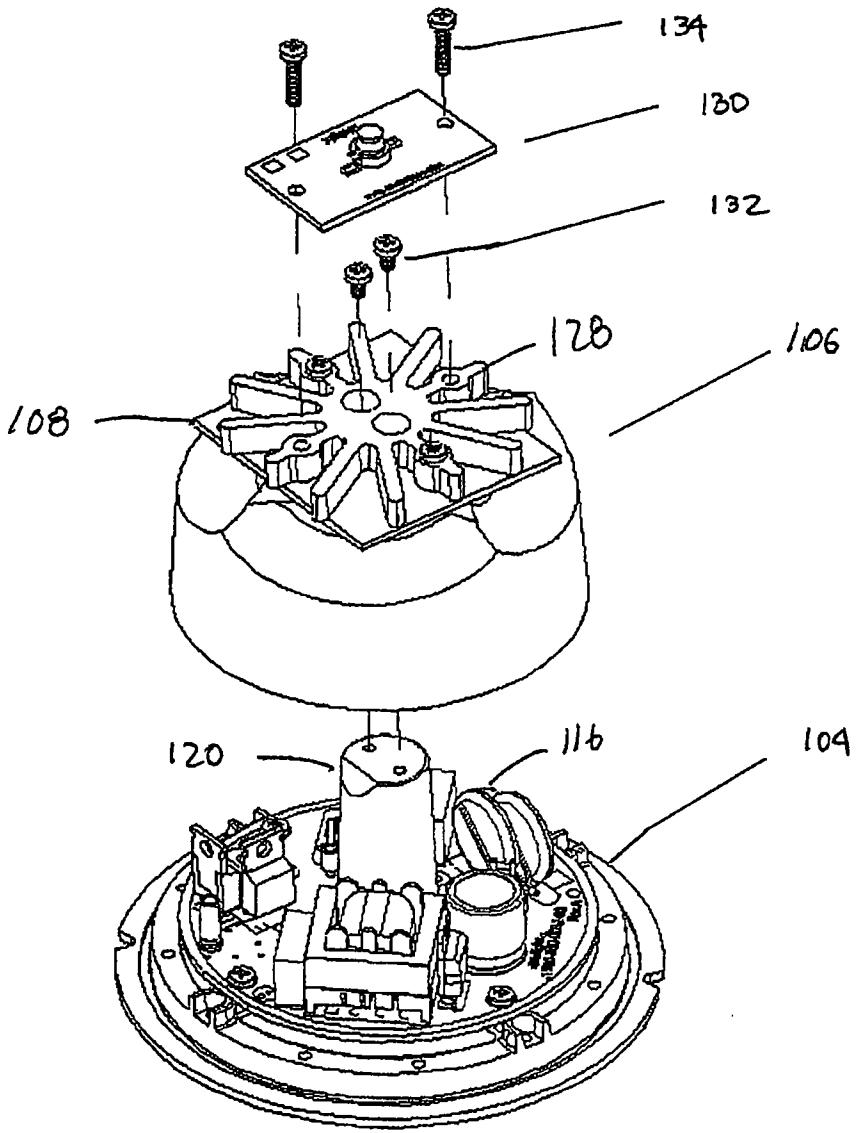
FIG. 7 depicts an exploded view of an alternate embodiment of the metalized plastic reflector having a heat sink and an upward directed LED.

FIG. 7 illustrates an exploded view of an alternate embodiment of the metalized plastic reflector 106 having a heat sink 128 and an upward directed LED 130. Having the upward directed LED 130 provides more light in the upward direction. In one embodiment, the upward directed LED 130 may be a wide emitting lambertian style with a peak around 0°. In another embodiment, the upward directed LED 130 may be a side emitting style LED with a peak around 80°. The upward directed LED 130 may also be mounted on a metal core circuit board for heat transfer.

The heat sink 128 may be positioned between the LED circuit board 108 and the upward directed LED 130 for mounting and thermal purposes. In one embodiment, the heat sink 128 may be star shaped. The upward directed LED 130 may be mounted to the heat sink 128 via screws 134. The heat sink 128 may be mounted to the LED circuit board 108 via screws 132.

While various embodiments have been described above, it should be understood that they have been presented by way of example only, and not limitation. Thus, the breadth and scope of a preferred embodiment should not be limited by any of the above-described embodiments, but should be defined only in accordance with the following claims and their equivalents.

What is claimed is:

1. An omnidirectional light emitting diode (LED) light, comprising:

a metal base comprising a stalk;

a power supply coupled to said metal base;

a reflector coupled to said metal base, the reflector comprising one or more reflector cups and enclosing said power supply, wherein the one or more reflector cups form a circular edge of the reflector, wherein the reflector and the one or more reflector cups are a single seamless piece;

an LED circuit board comprising one or more LEDs coupled to an upper portion of said reflector, wherein a light emitted from each one of said one or more LEDs is reflected by a first side of said reflector opposite a second side of said reflector enclosing said power supply, wherein said LED circuit board is coupled to said reflector where each one of said one or more LEDs points downward into a respective one of said one or more reflector cups; and a lens coupled to said metal base and enclosing said LED circuit board and said reflector.

2. The omnidirectional LED light of claim 1, wherein said LED circuit board is coupled to said reflector where said one or more LEDs are directed along an axis of said stalk toward said metal base.

3. The omnidirectional LED light of claim 1, wherein said reflector comprises metalized plastic.

4. The omnidirectional LED light of claim 1, wherein said one or more reflector cups are designed to distribute the light from said one or more LEDs in a full 360 degree radial coverage.

5. The omnidirectional LED light of claim 1, wherein said one or more reflector cups are conic.

6. The omnidirectional LED light of claim 5, wherein said one or more reflector cups comprise two axes of curvature, wherein each one of said two axes of curvature is not the same.

7. The omnidirectional LED light of claim 1, wherein said metal base is designed for various mounting configurations via one or more different types of collars.

8. The omnidirectional LED light of claim 1, wherein said lens is free of optical features.

9. The omnidirectional LED light of claim 1, wherein said stalk is coupled to said LED circuit board to provide heat transfer away from said LED circuit board and said power supply.

10. An omnidirectional light emitting diode (LED) light, comprising:

a reflector comprising one or more reflector cups, wherein the one or more reflector cups form a circular edge of the reflector, wherein the reflector and the one or more reflector cups are a single seamless piece;

an LED circuit board comprising one or more LEDs coupled to an upper portion of said reflector, wherein said LED circuit board is coupled to said reflector where each one of said one or more LEDs points downward into a respective one of said one or more reflector cups;

a heat sink coupled to said LED circuit board;

at least one LED coupled to said heat sink;

a metal base comprising a stalk coupled to said reflector;

a power supply coupled to said metal base and enclosed by said reflector, wherein a light emitted from said at least one LED is reflected by a first side of said reflector opposite a second side of said reflector enclosing said power supply; and a lens coupled to said metal base and enclosing said LED circuit board, said reflector, said heat sink and said at least one LED coupled to said heat sink.

11. The omnidirectional LED light of claim 10, wherein said heat sink is star shaped.

12. The omnidirectional LED light of claim 10, wherein said at least one LED coupled to said heat sink provides the light in an upward direction.

13. The omnidirectional LED light of claim 10, wherein said LED circuit board is coupled to said reflector where said one or more LEDs are directed along an axis of said stalk toward said metal base.

14. The omnidirectional LED light of claim 10, wherein said one or more reflector cups are designed to distribute the light from said one or more LEDs in a full 360 degree radial coverage.

15. The omnidirectional LED light of claim 10, wherein said one or more reflector cups are conic.

16. The omnidirectional LED light of claim 15, wherein said one or more reflector cups comprise two axes of curvature, wherein each one of said two axes of curvature is not the same.

17. The omnidirectional LED light of claim 10, wherein said lens is free of optical features.

18. A reflector for use in an omnidirectional light emitting diode (LED) light, comprising:

a cavity, wherein said cavity comprises a first side for enclosing a power supply;

a means for coupling one or more LEDs to an upper portion of a second side of said cavity that is opposite said first side of said cavity, wherein a light emitted from said one or more LEDs is reflected by said second side of said cavity; and one or more reflector cups made of metalized plastic opposite said cavity for receiving a respective one of said one or more LEDs, wherein the one or more LEDs are positioned downward where each one of said one or more LEDs points downward into a respective one of said one or more reflector cups, wherein the one or more reflector cups form a circular edge of the reflector, wherein the reflector, the cavity and the one or more reflector cups are a single seamless piece, wherein said one or more reflector cups comprise:

a conic shape; and two different axes of curvature.

* * * * *